United States Patent [19]

Salerno et al.

[11] Patent Number: 4,654,578

[45] Date of Patent: Mar. 31, 1987

[54] DIFFERENTIAL REFERENCE VOLTAGE GENERATOR FOR NMOS SINGLE-SUPPLY INTEGRATED CIRCUITS

[75] Inventors: Franco Salerno; Mario Sartori, both of Turin, Italy

[73] Assignee: Cselt-Centro Studi E Laboratori Telecomunicazioni SpA, Turin, Italy

[21] Appl. No.: 779,087

[22] Filed: Sep. 20, 1985

[30] Foreign Application Priority Data

Nov. 22, 1984 [IT] Italy ..... 68164 A/84

[51] Int. Cl.[4] ..... G05F 3/16

[52] U.S. Cl. ..... 323/313; 307/304

[58] Field of Search ..... 323/313, 314, 315, 907; 307/296 R, 297, 304

[56] References Cited

U.S. PATENT DOCUMENTS

| | | | |
|---|---|---|---|
| 4,347,476 | 8/1982 | Tam | 323/313 |
| 4,446,383 | 5/1984 | Concannon et al. | 323/313 X |
| 4,454,467 | 6/1984 | Sakaguchi | 323/313 |

OTHER PUBLICATIONS

Blauschild et al., "A New NMOS Temperature-Stable Voltage Reference", IEEE Journal of Solid-State Circuits, vol. SC-13, No. 6, Dec. 1978, pp. 767-773.

*Primary Examiner*—Peter S. Wong

*Attorney, Agent, or Firm*—Karl F. Ross; Herbert Dubno

[57] ABSTRACT

Voltage reference is generated by a current generator which, through a current-mirror amplifier, biases an enhancement MOS transistor as well as a depletion one, so that the desired voltage is equal to the difference between their threshold voltages.

2 Claims, 1 Drawing Figure

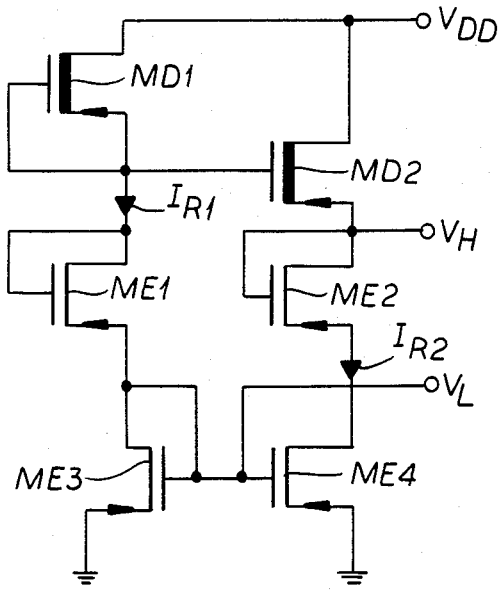
VDD
MD1
MD2
IR1
VH
ME1
ME2
IR2
VL
ME3
ME4

DIFFERENTIAL REFERENCE VOLTAGE GENERATOR FOR NMOS SINGLE-SUPPLY INTEGRATED CIRCUITS

FIELD OF OF THE INVENTION

The present invention relates to integrated circuit technology and more particularly it concerns a differential reference voltage generator for NMOS single-supply integrated circuits.

BACKGROUND OF THE INVENTION

In integrated analog circuits in NMOS technology (n-channel MOS) with a single voltage supply having not high level (e.g. 5 V), some circuit parts have limited output voltage swing and require a differential reference voltage, i.e. two reference voltages for minimum and maximum signal levels, since minimum signal level is different from ground; besides the difference between the two reference voltages is to remain stable.

Examples of such circuit parts are analog-to-digital or digital-to-analog converters where the weighting network output is decoupled by a voltage follower amplifier whose output voltage swing is limited and requires a voltage reference different from ground for minimum signal level.

NMOS single-supply circuits for generating single reference voltages are already known in the art, as that described in the paper "A new NMOS Temperature-Stable Voltage Reference" by R. A. Blauschild et al., IEEE Journal of Solid-State Circuits, vol. SC-13, pp. 767–774, December 1978.

In said circuit the reference voltage is derived from the difference between gate-source threshold voltages of an enhancement and a depletion MOS transistors both implemented with the same technology. Reference voltage is kept stable by a feedback obtained with a high-gain differential amplifies; that gives rise to serious stability problems, making it necessary to insert a compensating network, for the feedback loop, taking up a large silicon area. Moreover, reference voltage has a fixed and not-programmable value.

OBJECTS OF THE INVENTION

These problems are overcome by the present invention of a differential reference voltage generator which does not require a high-gain feedback loop to compensate for thermal drift, and wherein the differential voltage is maintained stable by annulling the difference between temperature-dependent terms in the equations of voltages and currents of the network which generates said differential voltage.

Besides the mean value of differential voltage can be varied with respect to ground.

It is a particular object of the present invention the device described in claim 1.

SPECIFIC DESCRIPTION

The characteristics of the present invention will be now described with reference to a non-limiting example thereof, in connection with the annexed drawing, wherein the electric diagram of the generator is shown.

In the FIGURE MD1, MD2 denote two MOS depletion transistors, whose drains are connected to supply voltage $V_{DD}$, and whose gates are connected to one another and to MD1 source.

ME1, ME2 denote two MOS enhancement transitors, whose drains are connected to their respective gates and to the sources of MD1 and MD2 respectively.

ME3, ME4 denote two MOS enhancement transistors, which have drains connected to ME1, ME2 sources respectively, gates interconnected, and sources connected to ground.

Besides drain and gate of ME3 are interconnected.

ME3 and ME4 are connected in "current mirror" configuration, that is why their drain currents have equal value. In addition transistor MD2 is connected in common-drain configuration.

Voltage $V_H$ present at the source of MD2 is the higher-level reference voltage. Voltage $V_L$ present at the gate of ME3 is the lower-level reference voltage.

Value $V_{DIF}=V_H-V_L$ is the required differential reference voltage.

In the FIGURE all the transistors are n-channel transistors. The general equation which expresses drain current $I_D$ versus gate-source voltage $V_{GS}$ in a MOS transistor in strong inversion is as follows:

$$I_D=\beta\cdot K(V_{GS}-V_T)^2/2 \tag{1}$$

where $\beta=\mu\cdot C_{ox}$, which $\mu[m^2\cdot s/V]$ charge-carrier mobility, and $C_{ox}$ $[F/m^2]$ specific gate capacity; $K=W/L$ with W and L channel cross-section and length respectively; $V_T$ gate-source threshold voltage.

The values of current and voltage in the circuit shown in the FIGURE can be calculated by means of equation (1). More particularly current $I_{R1}$, which is the drain current of transistors MD1, ME1 and ME3 is:

$$I_{R1}=\beta_{MD1}\cdot K_{MD1}\cdot(V_{MD1})^2/2 \tag{2}$$

where the parameters are those of transistor MD1, whose $V_{GS}$ is equal to zero, as it results also from the FIGURE.

Voltage $V_L$ is gate-source voltage $V_{GSME3}$ of transistor ME3; making use of equations (1) and (2) we derive:

$$V_L = V_{GSM3} = V_{TME3} + \sqrt{2\,I_R/\beta_{ME3}\cdot K_{ME3}} \tag{3}$$

Voltage $V_H$ will be on the contrary:

$$V_H = V_{GSME3} + V_{GSME1} - V_{GSMD2} = V_{GSME3} + V_{TME1} + \sqrt{2\,I_{R1}/\beta_{ME1}\cdot K_{ME1}} - V_{TMD2} - \sqrt{2\,I_{R2}/\beta_{MD2}\cdot K_{MD2}} \tag{4}$$

There considering that $I_{R1}=I_{R2}$, and that $I_{R2}$ is the drain current of MD2, ME2, ME4 the result will be:

$$V_{DIF} = V_{TME1} - V_{TMD2} + \sqrt{2\,I_{R1}}\cdot(1/\sqrt{\beta_{ME1}K_{ME1}} - 1/\sqrt{\beta_{MD2}K_{MD2}}) \tag{5}$$

Differential reference voltage $V_{DIF}$ depends therefore on the difference of threshold voltages of transistors ME1 and MD2, and on a term which can be kept equal to 0 by dimensioning said transistors so that:

$$\beta_{ME1}\cdot K_{ME1}=\beta_{MD2}\cdot K_{MD2}$$

Therefore by duly dimensioning the transistors whereon value $V_{DIF}$ depends, terms varying with temperature in equation (5) annul each other.

Hence $V_{DIF}$ is very stable.

Voltages $V_H$ or $V_L$ can be set by duly dimensioning transistors ME2, ME3, ME4, so as to exploit as well as possible the output voltage swing of the amplifier which requires the reference voltage generator.

We claim:

1. Differential reference voltage generator for NMOS single-supply integrated circuits, characterized in that it comprises:

Power Supply

A first MOS depletion transistor (MD1) Have a first gate and a first source connected together, and a first drain connected with said power supply ($V_{DD}$);

a second MOS depletion transistor (MD2) have a second drain connected with said power supply and a second gate connected with said first source of the first transistor and having a second source;

a third MOS enhancement transistor (ME1) have a third drain and a third gate connected together and with said first source of the first transistor and having a third source;

a fourth MOS enhancement transistor (ME2) having a fourth drain and a fourth drain and gate connected together and with said second source of the second transistor;

a fifth MOS enhancement transistor (ME3) having a fifth drain and a fifth gate connected together and with said third source of the third transistor and having a fifth source being grounded;

a sixth MOS enhancement transistor (ME4) having a sixth drain connected with said fourth source of the fourth transistor having a sixth source grounded; and having a sixth gate connected with said fifth gate of the fifth transistor;

differential reference voltage being the difference between the voltage present at said second source of the second transistor (MD2) and that present at the gate of the fifth and sixth transistor (ME3, ME4).

2. Generator as in claim 1, characterized in that said second and third transistors (MD2, ME1) are dimensioned so that the product of parameters $\beta$, K of the second tranistor is equal to the product of parameters $\beta$, K of the third transistor, where $\beta=\mu \cdot C_{ox}$, with $\mu$=charge-carrier mobility and $C_{ox}$=specific gate capacity; $K=W/L$, with W and L channel cross-section and length respectively.

* * * * *